US006145553A

United States Patent [19]

Sofy

[11] Patent Number: 6,145,553

[45] Date of Patent: Nov. 14, 2000

[54] TRICK OR TREAT BAG

[75] Inventor: Janet Sofy, Troy, Mich.

[73] Assignee: HMS Mfg. Co., Troy, Mich.

[21] Appl. No.: 09/228,196

[22] Filed: Jan. 11, 1999

[51] Int. Cl.[7] ..... B65B 1/04

[52] U.S. Cl. ..... 141/314; 141/391

[58] Field of Search ..... 141/114, 313, 141/314, 317, 391; 222/571; 446/329, 175, 395; 383/33, 34, 36

[56] References Cited

U.S. PATENT DOCUMENTS

| | | | |
|---|---|---|---|
| D. 397,583 | 9/1998 | Allison | D7/601 |
| 700,524 | 5/1902 | Marcotte . | |
| 2,891,704 | 6/1959 | Morrison | 222/543 |
| 3,321,103 | 5/1967 | Phillips . | |
| 3,656,668 | 4/1972 | Liebertz | 222/570 |
| 4,263,743 | 4/1981 | Hanson et al. | 46/228 |
| 5,080,626 | 1/1992 | Maddi | 446/329 |
| 5,222,802 | 6/1993 | Beck | 362/156 |
| 5,283,567 | 2/1994 | Howes | 340/815.69 |
| 5,467,918 | 11/1995 | Glover | 232/43.1 |
| 5,567,054 | 10/1996 | Dalgleish | 383/10 |

*Primary Examiner*—Steven O. Douglas

*Attorney, Agent, or Firm*—Howard & Howard

[57] ABSTRACT

An assembly (10) for collecting candy comprises a channel (20) having an upper opening (22) and a lower opening (24) for receiving candy in the upper opening (22) and directing the candy out of the lower opening (24) for deposition in a receptacle (24), and a lid (30) moveably supported on the channel (20) for movement between a closed position covering the upper opening (22) and an open position providing access to the upper opening (22). The assembly (10) is characterized by the lid (30) presenting a face (70) overlying the upper opening (22). The face (70) includes a mouth (71), a space for two eyes (72), nostrils (73), the back of a head (74), a forehead (75) above the eyes (72), ears (77), and teeth (76). The channel (20) includes a pivotal member (21) for pivotally supporting the face (70) on the channel (20) and an actuation device (31) for manually pivoting the face (70) relative to the channel (20). The channel (20) includes an attachment device (50) for attaching the receptacle (24) to the channel (20). An electronics package (60) supported by the lid (30) for emitting at least one of light and sound is attached to a shelf (62) affixed to the lid (30) for securing the electronics package (60) to the lid (30). The face (70) includes a space for two eyes (72) and the space defines openings with the lights (64) disposed in the openings. Stickers (80) are included for decorating the face (70).

22 Claims, 3 Drawing Sheets

10
20
21
22
24
26
28
29
30
31
32
34
36
40
50
52
60
62
64
68

TRICK OR TREAT BAG

BACKGROUND OF THE INVENTION

1. Technical Field

An assembly for collecting candy.

2. Description of the Prior Art

During Halloween, children enjoy dressing up in festive costumes to collect candy door to door. In addition to the costumes, children often enjoy carrying props to add to the festive atmosphere. A required addition to every costume is a container to hold candy that has been collected door to door. One such collection device includes a big hand with a hole in the hand and a bag depending from the hand to collect the objects dropped through the hole in the hand. Although container styles range from merely an old pillow case to a plastic pumpkin, these containers are primarily only functional. A container which is practical and yet could be fashioned as a theme related prop adds to the enjoyment of Halloween.

SUMMARY OF THE INVENTION AND ADVANTAGES

An assembly for collecting candy comprises a channel having an upper opening and a lower opening for receiving candy in the upper opening and directing the candy out of the lower opening for deposition in a receptacle, and a lid moveably supported on the channel for movement between a closed position covering the upper opening and an open position providing access to the upper opening. The assembly is characterized by the lid presenting a face overlying the upper opening.

The subject invention provides a structural combination for collecting candy which is fabricated into an entertaining prop in the form of a character. The lid presents a face which, when pivoted open, gives the impression of a character holding its mouth open waiting for candy to be deposited.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
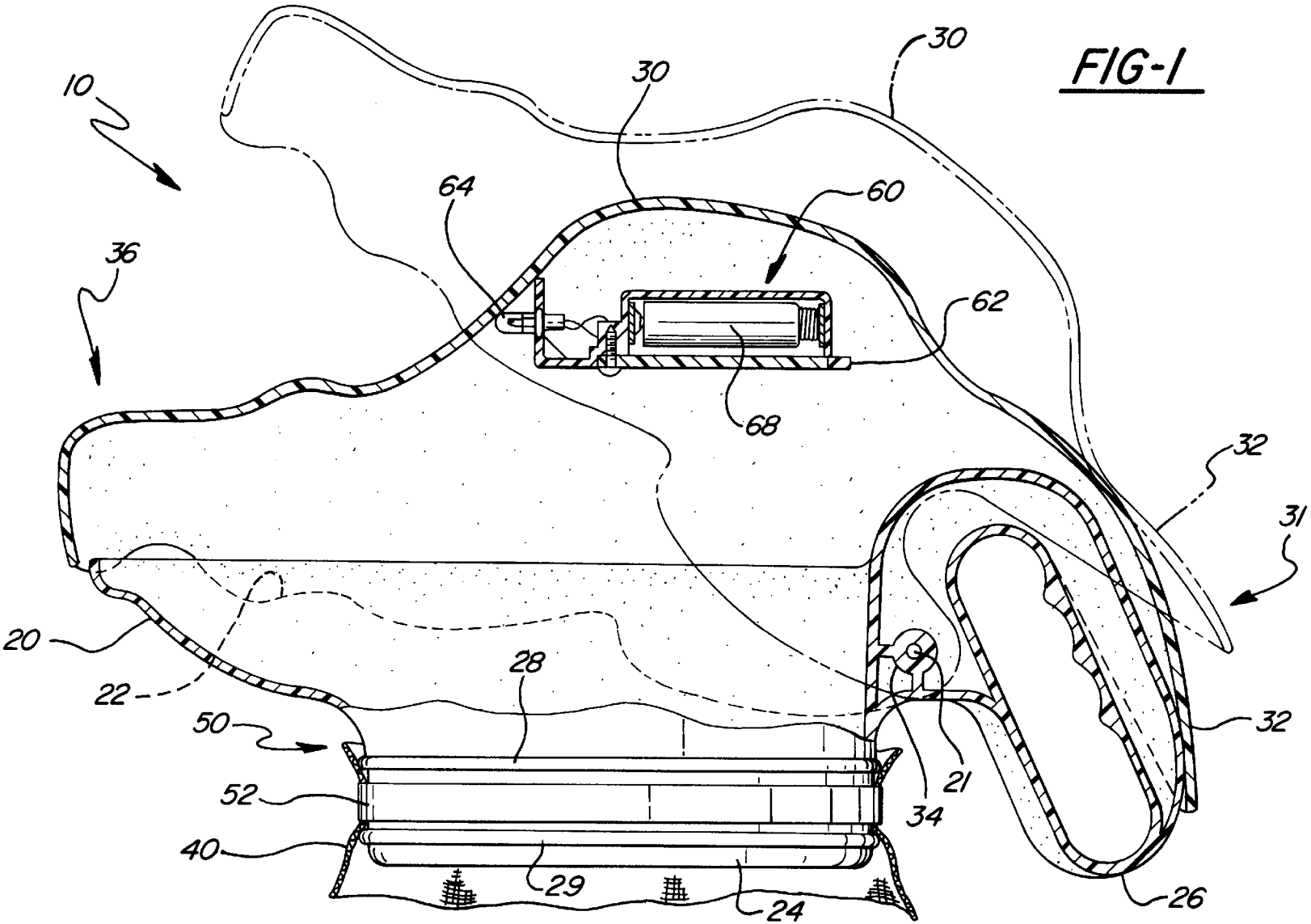
FIG. 1 is a side elevational view of the assembly showing the decorative lid in the closed position in solid lines and in an open position in phantom lines.

Referring to the Figures, wherein like numerals indicate like or corresponding parts throughout the several views, an assembly 10 for collecting candy comprises a channel 20 having an upper opening 22 and a lower opening 24 for receiving candy in the upper opening 22 and directing the candy out of the lower opening 24 for deposition in a receptacle 24 attached thereto. The assembly 10 includes a lid 30 moveably supported on the channel 20 for movement between a closed position covering the upper opening 22 and an open position providing access to the upper opening 22 for depositing candy.

The assembly 10 is characterized by the lid 30 presenting a face 70 overlying the upper opening 22. The face 70 includes a mouth 71, a space for two eyes 72, nostrils 73, the back of a head 74, a forehead 75 above the eyes 72, ears 77, and teeth 76. The face 70 resembles a character; e.g., a dragon, cat, dog, skeleton, ghost or jack-o-lantern.

Figure 2:
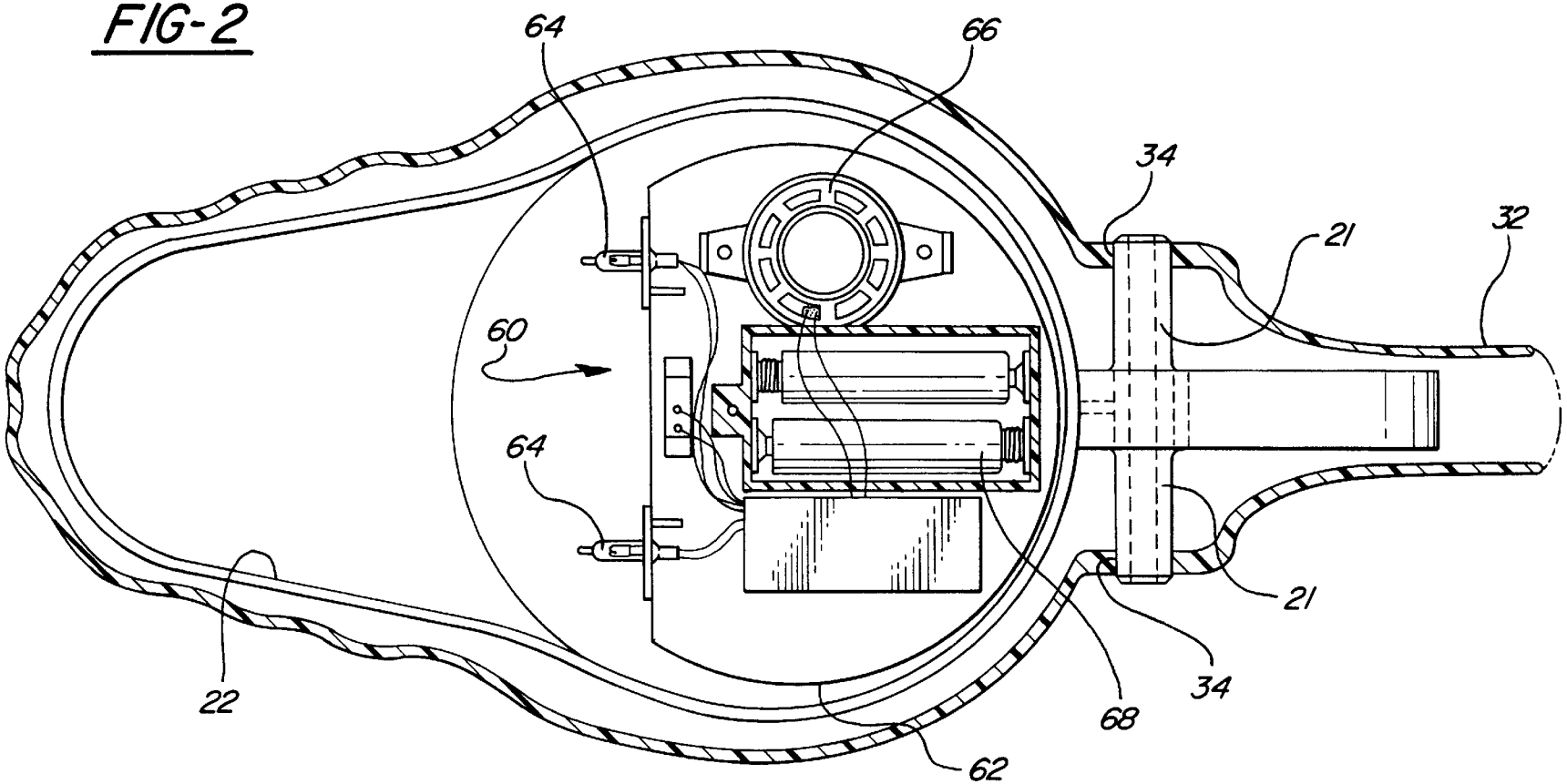
FIG. 2 is a top view of the assembly showing details of the electronics package.
Figure 3:
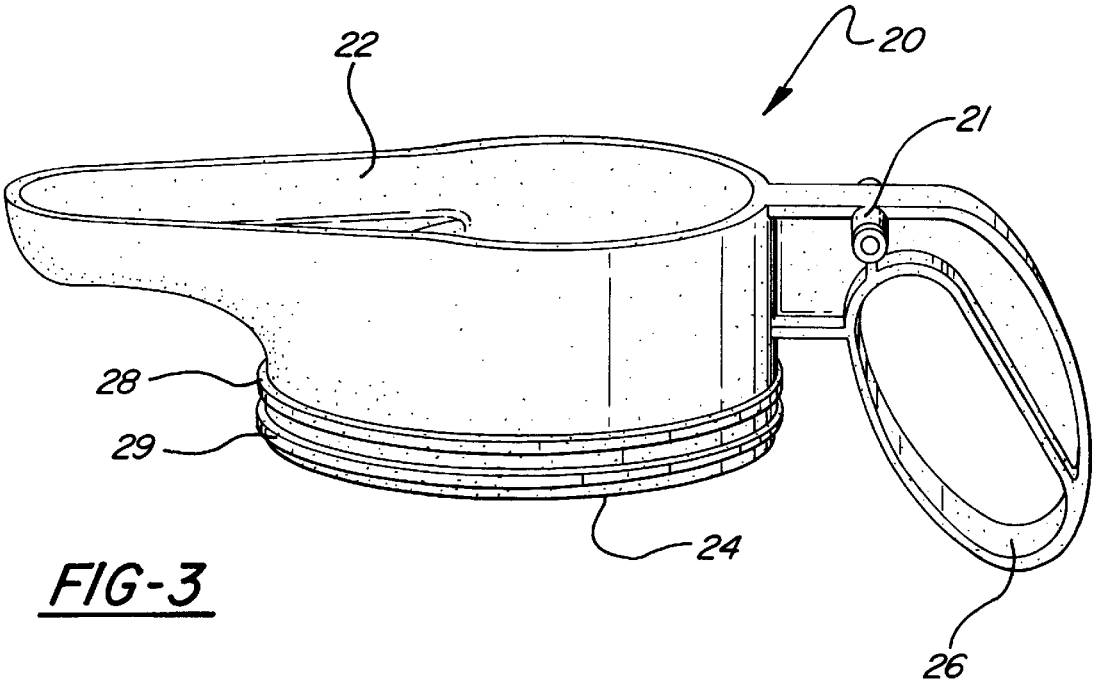
FIG. 3 is a side view of the channel showing the upper and lower openings with the cover removed.
Figure 4:
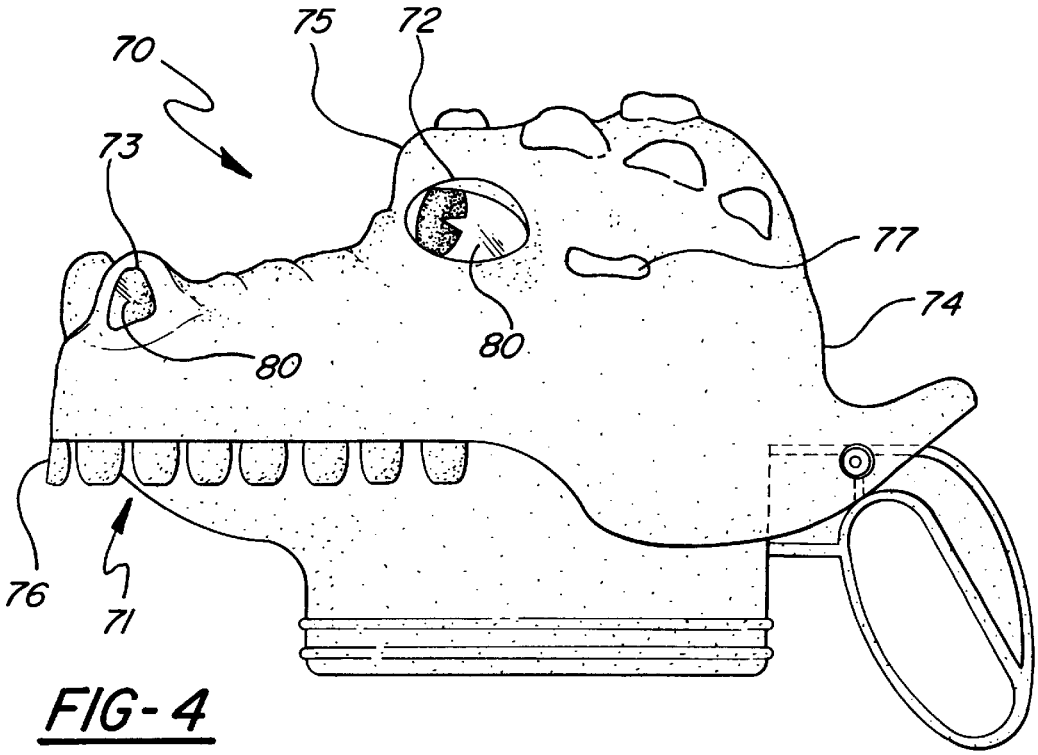
FIG. 4 is a side elevational view of an alternative embodiment with the lid in the form of a monster.

A pivotal member 21 supports the face 70 on the channel 20. For example, FIG. 1 shows the pivotal member 21 in the form of a right and left pin projecting from either side of a handle 26 attached to the channel 20 for supporting the channel 20. The pins project through right and left holes 34 in the lid 30 providing the pivotal interconnection. However, one pin may be used instead of two. An actuation device 31 for manually pivoting the face 70 relative to said channel 20 opens the assembly 10 for depositing candy. FIGS. 1 and 2 show the actuation device 31 in the form of a lever 32 extending from that part of the face 70 that resembles the back of a head 74 so that the lever 32 is opposite the mouth 71 from the pins and extends over the handle 26. The face 70 can be opened relative to the channel 20 by depressing the lever 32 with the thumb of a hand gripping the handle 26. Alternate methods to open the face 70 are contemplated including a trigger within the handle 26, spring actuation, and voice activation.

The assembly 10 includes an attachment device generally shown at 50 for attaching the receptacle 24 to the channel 20. For example, FIG. 1 shows a band 52 encircling the periphery of the channel 20. A receptacle 24 is trapped between the band 52 and the channel 20. An upper rib 28 and a lower rib 29 are molded into the channel 20 for locating the band 52 there between and for securing the receptacle 24. The receptacle 24 can be a rigid or flexible in form.

An electronics package 60 is supported by the lid 30 for emitting at least one of light and sound. A shelf 62 affixed to the underside of the lid 30 secures the electronics package 60 to the lid 30. For one embodiment of the assembly, the electronics package 60 includes lights 64 and the space for two eyes 72 defines openings with the lights 64 disposed in the openings. Light emitted from the lights 64 and sound emitted from a speaker 66 can be activated by a shock sensor (not shown) when the face 70 is opened and closed. Batteries 68 affixed to the shelf 62 provide electrical power for the electrical package 60.

The assembly 10 includes stickers 80 for decorating the face 70. A variety of stickers 80 are included with the assembly 10 for changing the appearance of the face 70. Different combinations of the stickers 80 can be applied for different facial appearance. For an additional embodiment the space for two eyes 72 provides a surface for applying stickers 80 representing eyes. Additionally, the stickers 80 can take the form of teeth, ears, whiskers, spots, nostrils, and any other facial feature.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A channel (20) having an upper opening (22) and a lower opening (24) for receiving candy in the upper opening (22) and directing the candy out of the lower opening (24) for deposition in a receptacle (24), and a lid (30) moveably supported on said channel (20) for movement between a closed position covering said upper opening (22) and an open position providing access to said upper opening (22), said assembly (10) characterized by said lid (30) presenting a face (70) of a character overlying said upper opening (22).

2. An assembly (10) as set forth in claim 1 wherein said face (70) includes a mouth (71) of the character.

3. An assembly (10) as set forth in claim 1 wherein said face (70) includes a space for two eyes (72) of the character.

4. An assembly (10) as set forth in claim 3 wherein said face (70) includes a back of a head (74) of the character disposed behind said eyes (72).

5. An assembly (10) as set forth in claim 3 wherein said face (70) includes a forehead (75) of the character above said eyes (72).

6. An assembly (10) as set forth in claim 1 including a pivotal member (21) for pivotally supporting said face (70) on said channel (20).

7. An assembly (10) as set forth in claim 6 including an actuation device (31) for manually pivoting said face (70) relative to said channel (20).

8. An assembly (10) as set forth in claim 7 further including an attachment device (50) for attaching said receptacle (24) to said channel (20).

9. An assembly (10) as set forth in claim 1 wherein said assembly (10) includes stickers (80) for decorating said face (70).

10. A channel (20) having an upper opening (22) and a lower opening (24) for receiving candy in the upper opening (22) and directing the candy out of the lower opening (24) for deposition in a receptacle (24), and a lid (30) moveably supported on said channel (20) for movement between a closed position covering said upper opening (22) and an open position providing access to said upper opening (22), said assembly (10) characterized by said lid (30) presenting a face (70) of a character overlying said upper opening (22), said face (70) includes nostrils (73) of the character.

11. A channel (20) having an upper opening (22) and a lower opening (24) for receiving candy in the upper opening (22) and directing the candy out of the lower opening (24) for deposition in a receptacle (24), and a lid (30) moveably supported on said channel (20) for movement between a closed position covering said upper opening (22) and an open position providing access to said upper opening (22), said assembly (10) characterized by said lid (30) presenting a face (70) of a character overlying said upper opening (22), said face (70) includes ears (77) of the character.

12. A channel (20) having an upper opening (22) and a lower opening (24) for receiving candy in the upper opening (22) and directing the candy out of the lower opening (24) for deposition in a receptacle (24), and a lid (30) moveably supported on said channel (20) for movement between a closed position covering said upper opening (22) and an open position providing access to said upper opening (22), said assembly (10) characterized by said lid (30) presenting a face (70) of a character overlying said upper opening (22), said face (70) includes teeth (76) of the character.

13. A channel (20) having an upper opening (22) and a lower opening (24) for receiving candy in the upper opening (22) and directing the candy out of the lower opening (24) for deposition in a receptacle (24), and a lid (30) moveably supported on said channel (20) for movement between a closed position covering said upper opening (22) and an open position providing access to said upper opening (22), said assembly (10) characterized by said lid (30) presenting a face (70) of a character overlying said upper opening (22), an electronics package (60) supported by said lid (30) for emitting at least one of light and sound.

14. An assembly (10) as set forth in claim 13 including a shelf (62) affixed to said lid (30) for securing said electronics package (60) to said lid (30).

15. An assembly (10) as set forth in claim 14 wherein said electronics package (60) includes lights (64).

16. An assembly (10) as set forth in claim 15 wherein said face (70) includes a space for two eyes (72) of the character.

17. An assembly (10) as set forth in claim 16 wherein said space for two eyes (72) defines openings with said lights (64) disposed in said openings.

18. A channel (20) having an upper opening (22) and a lower opening (24) for receiving candy in the upper opening (22) and directing the candy out of the lower opening (24) for deposition in a receptacle (24), and a lid (30) movably supported on said channel (20) for movement between a closed position covering said upper opening (22) and an open position providing access to said upper opening (22), said assembly (10) characterized by said lid (30) presenting a face (70) of a character overlying said upper opening (22), said lid (30) and said opening (22) of said channel (20) present indicia of a mouth (71) of the character.

19. An assembly (10) as set forth in claim 18 wherein said face (70) includes indicia representing two eyes (72) of the character.

20. An assembly (10) as set forth in claim 18 wherein said face (70) includes indicia representing nostrils (73) of the character.

21. An assembly (10) as set forth in claim 18 wherein said face (70) includes indicia representing teeth (76) of the character covering said opening (22) in said closed position.

22. An assembly (10) as set forth in claim 18 wherein said assembly (10) includes stickers (80) for providing indicia of facial features of said face (70) of the character.

* * * * *